US007802974B2

(12) United States Patent
Rockwell et al.

(10) Patent No.: US 7,802,974 B2
(45) Date of Patent: Sep. 28, 2010

(54) SCREW COMPRESSOR HAVING ASYMMETRIC SEAL AROUND ROTOR AXIS

(75) Inventors: David M. Rockwell, Cicero, NY (US); Frederick L. Miller, Jr., Syracuse, NY (US); Yan Tang, Daphne, AL (US)

(73) Assignee: Carrier Corporation, Farmington, CT (US)

( * ) Notice: Subject to any disclaimer, the term of this patent is extended or adjusted under 35 U.S.C. 154(b) by 937 days.

(21) Appl. No.: 11/631,562

(22) PCT Filed: Oct. 6, 2004

(86) PCT No.: PCT/US2004/033421

§ 371 (c)(1),
(2), (4) Date: Jan. 3, 2007

(87) PCT Pub. No.: WO2006/041494

PCT Pub. Date: Apr. 20, 2006

(65) Prior Publication Data

US 2007/0286758 A1 Dec. 13, 2007

Related U.S. Application Data

(63) Continuation-in-part of application No. 10/956,897, filed on Sep. 30, 2004, now Pat. No. 7,121,814.

(51) Int. Cl.
*F03C 2/00* (2006.01)
*F04C 2/00* (2006.01)
*F04C 15/00* (2006.01)

(52) U.S. Cl. ..... 418/144; 418/104; 418/201.1; 277/370; 277/399

(58) Field of Classification Search ..... 418/104, 418/140, 144, 197, 201.1; 277/399, 370
See application file for complete search history.

(56) References Cited

U.S. PATENT DOCUMENTS

| | | | | |
|---|---|---|---|---|
| 2,287,716 | A * | 6/1942 | Whitfield | 418/201.1 |
| 4,744,738 | A * | 5/1988 | Miki et al. | 418/126 |
| 5,695,327 | A * | 12/1997 | Heinen et al. | 418/144 |
| 6,485,279 | B2 * | 11/2002 | Zhong et al. | 418/141 |
| 2004/0170512 | A1 * | 9/2004 | Yannascoli et al. | 418/141 |

FOREIGN PATENT DOCUMENTS

| | | | |
|---|---|---|---|
| DE | 3602226 | A * | 7/1987 |
| GB | 648055 | A * | 12/1950 |

* cited by examiner

*Primary Examiner*—Theresa Trieu
(74) *Attorney, Agent, or Firm*—Bachman & LaPointe, P.C.

(57) ABSTRACT

A compressor includes a male rotor (26) having a screw-type boy portion (30) extending from a first end (31) to a second end (32) and held within a housing assembly for rotation about a first rotor axis (500). A female rotor (27, 28) has a screw-type female body portion (33, 34) meshed with the male body portion and extending from a first end (35, 36) to a second end (37, 38) and held within the housing assembly for rotation about a second rotor axis (501, 502). An end seal (120) has a first surface (126) engaging the female body portion first end and being asymmetric around the second axis.

18 Claims, 5 Drawing Sheets

SCREW COMPRESSOR HAVING ASYMMETRIC SEAL AROUND ROTOR AXIS

This is the 35 USC 371 National Stage Application of PCT/US2004/033421 which is a continuation-in-part of U.S. patent application Ser. No. 10/956,897, filed Sep. 30, 2004 now U.S. Pat. No. 7,121,814.

BACKGROUND OF THE INVENTION (1) Field of the Invention

The invention relates to compressors. More particularly, the invention relates to sealing of economized screw-type compressors.

(2) Description of the Related Art

Screw type compressors are commonly used in air conditioning and refrigeration applications. In such a compressor, intermeshed male and female lobed rotors or screws are rotated about their axes to pump the working fluid (refrigerant) from a low pressure inlet end to a high pressure outlet end. During rotation, sequential lobes of the male rotor serve as pistons driving refrigerant downstream and compressing it within the space between an adjacent pair of female rotor lobes and the housing. Likewise sequential lobes of the female rotor produce compression of refrigerant within a space between an adjacent pair of male rotor lobes and the housing. The interlobe spaces of the male and female rotors in which compression occurs form compression pockets (alternatively described as male and female portions of a common compression pocket joined at a mesh zone). In one implementation, the male rotor is coaxial with an electric driving motor and is supported by bearings on inlet and outlet sides of its lobed working portion. There may be multiple female rotors engaged to a given male rotor or vice versa.

When one of the interlobe spaces is exposed to an inlet port, the refrigerant enters the space essentially at suction pressure. As the rotors continues to rotate, at some point during the rotation the space is no longer in communication with the inlet port and the flow of refrigerant to the space is cut off. After the inlet port is closed, the refrigerant is compressed as the rotors continue to rotate. At some point during the rotation, each space intersects the associated outlet port and the closed compression process terminates. The inlet port and the outlet port may each be radial, axial, or a hybrid combination of an axial port and a radial port.

As the refrigerant is compressed along a compression path between the inlet and outlet ports, sealing between the rotors and housing is desirable for efficient operation. To increase the mass flow in a screw compressor an economizer is used. Typical economizer ports are located along the rotor length, positioned to become exposed to the compression pockets just after such pockets are shut off from the associated suction ports. At this location the refrigerant gas trapped within the rotors is near suction pressure. Connecting gas at a pressure above suction to the economizer ports allows for a quantity of gas to flow into the compressor. Furthermore, the feeding of gas into the rotors after suction is cut off increases the pressure of the trapped gas in the rotors. This reduces the amount of work required by the compressor. Also the economizer flow is above suction pressure, so the power for a given total refrigerant mass flow is reduced.

The suction port for a screw compressor can be axial, radial or a combination of both. The radial suction port cutoff is defined by the bore surrounding the rotor. The axial port is closed by the meshing of the screw rotors. Typical designs with both axial and radial suction ports require that the axial port be closed before or at the same time the radial port is closed.

To make the compressor more compact, shorter screw rotors are desirable. Also, using multiple female rotors about a single male rotor or multiple male rotors about a single female rotor may result in a shorter rotor set. By shortening the length of the rotors, the compression path gets shorter, which minimizes the opportunity and time required/available to inject economizer flow into the rotors.

Nevertheless, there remains room for improvement in the art.

SUMMARY OF THE INVENTION

To reduce the length of the rotors, but increase the length of the compression process, the radial suction port needs to be closed off sooner. However, by reducing the radial suction, the rotors would not mesh in time to close off the axial suction port. It would be desirable to close off the axial suction port to allow for a shorter radial suction port. Advantageously this would only close off a portion of the axial suction port to avoid having the economizer flow leak back to suction and to still allow for an axial suction flow component.

One aspect of the invention is a compressor having a housing assembly containing male and female rotors. The male rotor has a screw-type male body portion extending from a first end to a second end and held within the housing assembly for rotation about a first rotor axis. The female rotor has a screw-type female body portion enmeshed with the male body portion. The female body portion extends from a first end to a second end and is held within the housing assembly for rotation about a second rotor axis. An end seal has a first surface engaging the female rotor body portion first end and being asymmetric around the second axis.

In various implementations, the end seal may include a full-annulus base portion encircling the second rotor axis and a second portion bearing the first surface. The first surface may be essentially an annular segment of an extent between 30° and 270°. The first surface may be of only partial circumferential extent. The first surface may seal 1/12 to 3/4 of a lobe-swept area of said female body portion first end. The first surface may seal 1/4 to 1/2 of the lobe-swept area. A motor may be coupled to the male rotor to drive the male rotor at least in a first direction about the first rotor axis. The male rotor and motor may be coaxial. The motor may be an electric motor having a rotor and a stator and the male rotor may have a shaft portion extending into and secured to the motor's rotor. The end seal may be essentially unitarily formed of steel. A number of threaded fasteners may secure the end seal to the housing assembly.

Another aspect of the invention involves a compressor having a housing assembly, enmeshed male and female rotors, and suction and discharge plenums. The male and female rotor body portions may cooperate with the housing to define at least a first compression path between the suction plenum and the discharge plenum. An economizer port is at an intermediate location along the first compression path. The compressor includes means for resisting leakage from the economizer port to the suction plenum while still permitting an axial flow component from the suction plenum.

The means may comprise a rotor end seal with a circumferentially non-constant rotor engagement face. The rotor end seal may include a full-annulus base portion encircling the second rotor axis and a second portion bearing the rotor engagement face. The rotor engagement face may be essentially an annular segment of an extent between 30° and 270°.

The means may comprise a rotor end seal with a rotor engagement face of only partial circumferential extent. A second female rotor may have a screw-type female lobed body portion and may mesh with the male lobed body portion.

Another aspect of the invention involves a method for remanufacturing a compressor or engineering or reengineering a configuration of such compressor from a baseline condition to a second condition. The method includes providing an axial seal for sealing with a female rotor first end. The axial seal has a sealing surface asymmetric around a female rotor axis. The axial seal either replaces a baseline seal having a sealing surface symmetric around such axis or is located where there is no axial seal in the baseline condition. The compressor may include an economizer port.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
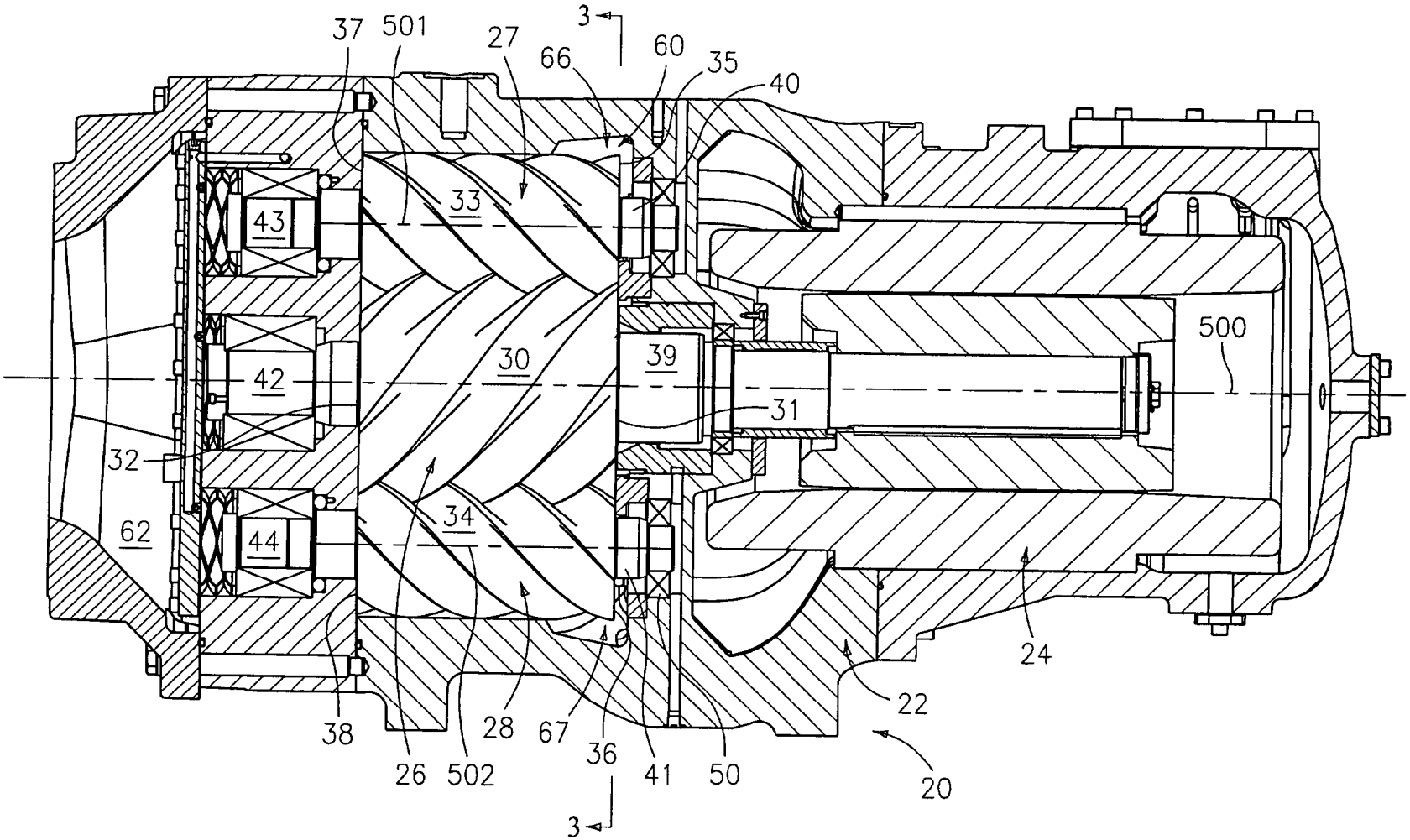
FIG. 1 is a longitudinal sectional view of a compressor according to principles of the invention.

FIG. 1 shows a compressor 20 having a housing assembly 22 containing a motor 24 driving rotors 26, 27, and 28 having respective central longitudinal axes 500, 501, and 502. In the exemplary embodiment, the male rotor 26 is centrally positioned within the compressor and has a male lobed body or working portion 30 extending between a first end 31 and a second end 32. The working portion 30 is enmeshed with female lobed body or working portions 33 and 34 of each female rotor 27 and 28. The working portions 33 and 34 have respective first ends 35 and 36 and second ends 37 and 38. Each rotor includes shaft portions (e.g., stubs 39, 40, 41, and 42, 43, 44 unitarily formed with the associated working portion) extending from the first and second ends of the associated working portion. Each of these shaft stubs is mounted to the housing by one or more bearing assemblies 50 for rotation about the associated rotor axis.

In the exemplary embodiment, the motor 24 is an electric motor having a rotor and a stator. A portion of the first shaft stub 39 of the male rotor 26 extends within the stator and is secured thereto so as to permit the motor 24 to drive the male rotor 26 about the axis 500. When so driven in an operative first direction about the axis 500, the male rotor drives the female rotors in an opposite second direction about their axes 501 and 502.

Figure 2:
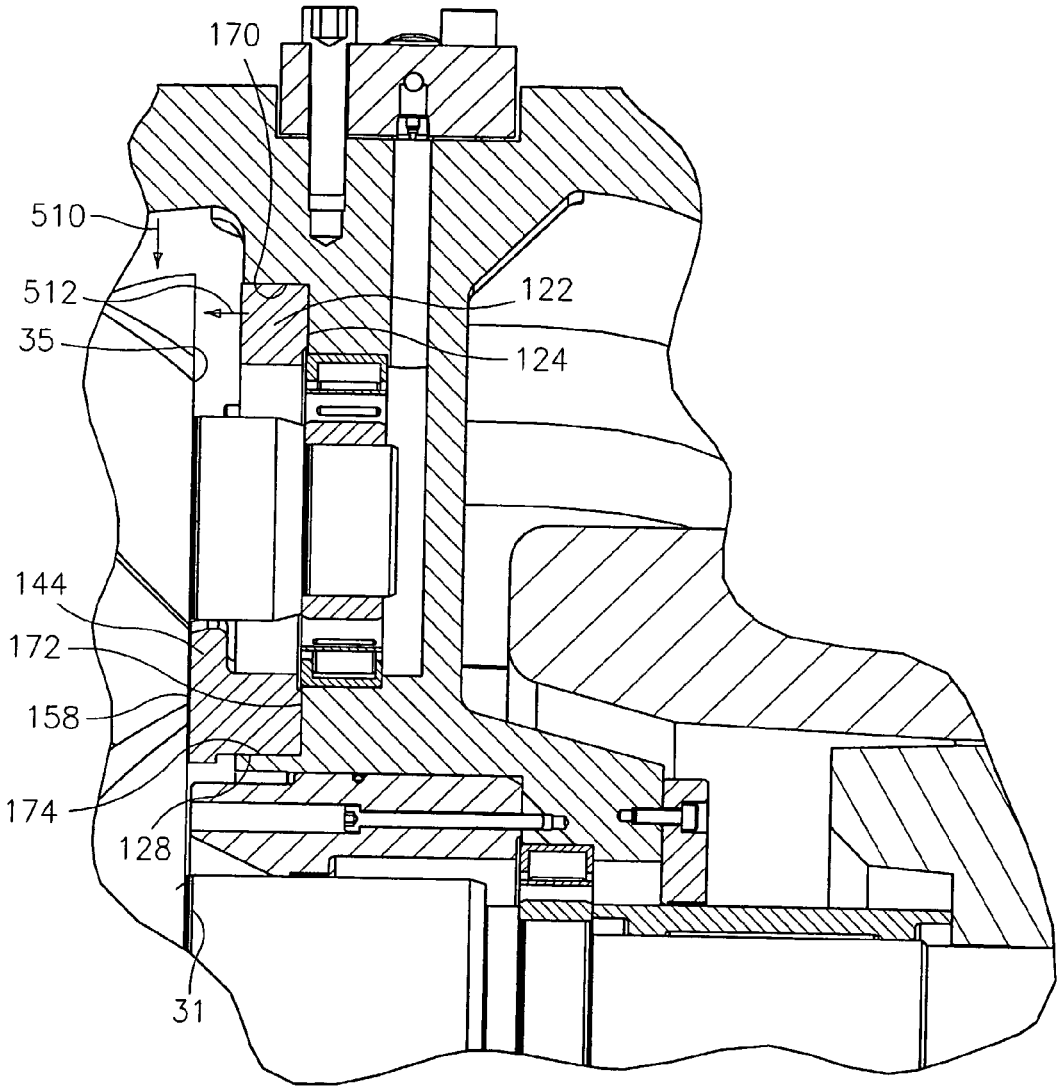
FIG. 2 is an enlarged view of a suction plenum area of the compressor of FIG. 1.

Surfaces of the housing combine with the enmeshed rotor bodies to define inlet and outlet ports to two pairs of compression pockets compressing and driving refrigerant from a suction (inlet) plenum 60 to a discharge (outlet) plenum 62. A first pair of male and female compression pockets is formed by the housing, male rotor, and the first female rotor. A second pair of male and female compression pockets is formed by the housing, male rotor and the second female rotor. In each pair, one such pocket is located between a pair of adjacent lobes of each rotor associated rotor. Depending on the implementation, the ports may be radial, axial, or a hybrid of the two. FIG. 1 shows first and second inlet ports 66 and 67. The exemplary inlet ports 66 and 67 are hybrid having a radial component admitting a radial inlet flow component 510 and an axial component emitting an axial inlet flow component 512 (FIG. 2).

Figure 3:
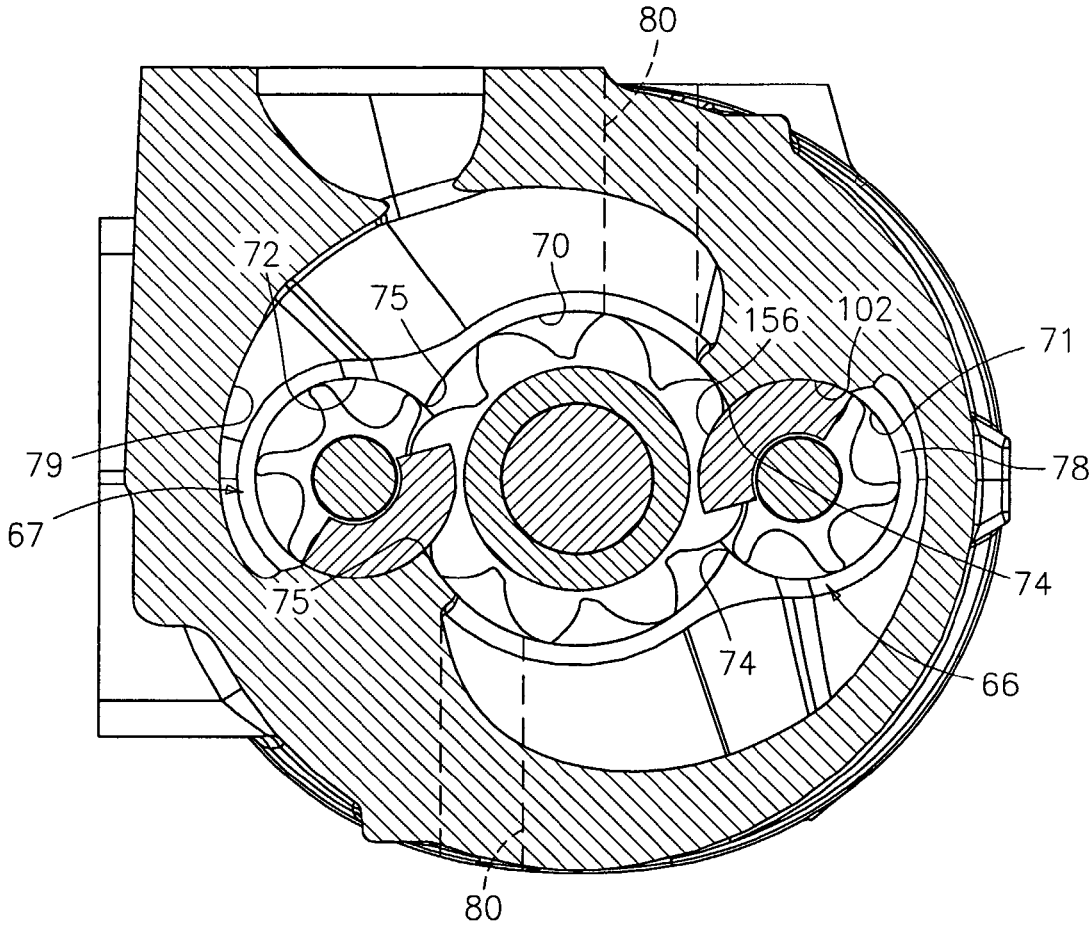
FIG. 3 is a transverse sectional view of the compressor of FIG. 1 taken along line 3-3.

FIG. 3 shows the housing interior surface as including circular cylindrical portions 70, 71, and 72 in close facing/sealing relationship with the apexes of the lobes of the respective working portions 30, 33, and 34. The portions 70 and 71 meet at a pair of opposed mesh zones 74 and the portions 70 and 72 meet at a pair of opposed mesh zones 75. The housing interior surface further includes portions cooperating to define the suction and discharge ports, with portion 78 for the port 66 and 79 for the port 67 shown. The compressor further includes economizer ports 80 positioned at an intermediate stage of the compression process (e.g., the first half of the process such that the economizer port is exposed to the compression pocket(s) only after the start of the compression has occurred and is closed off from such pocket(s) before ½ of the compression has occurred).

Figure 4:
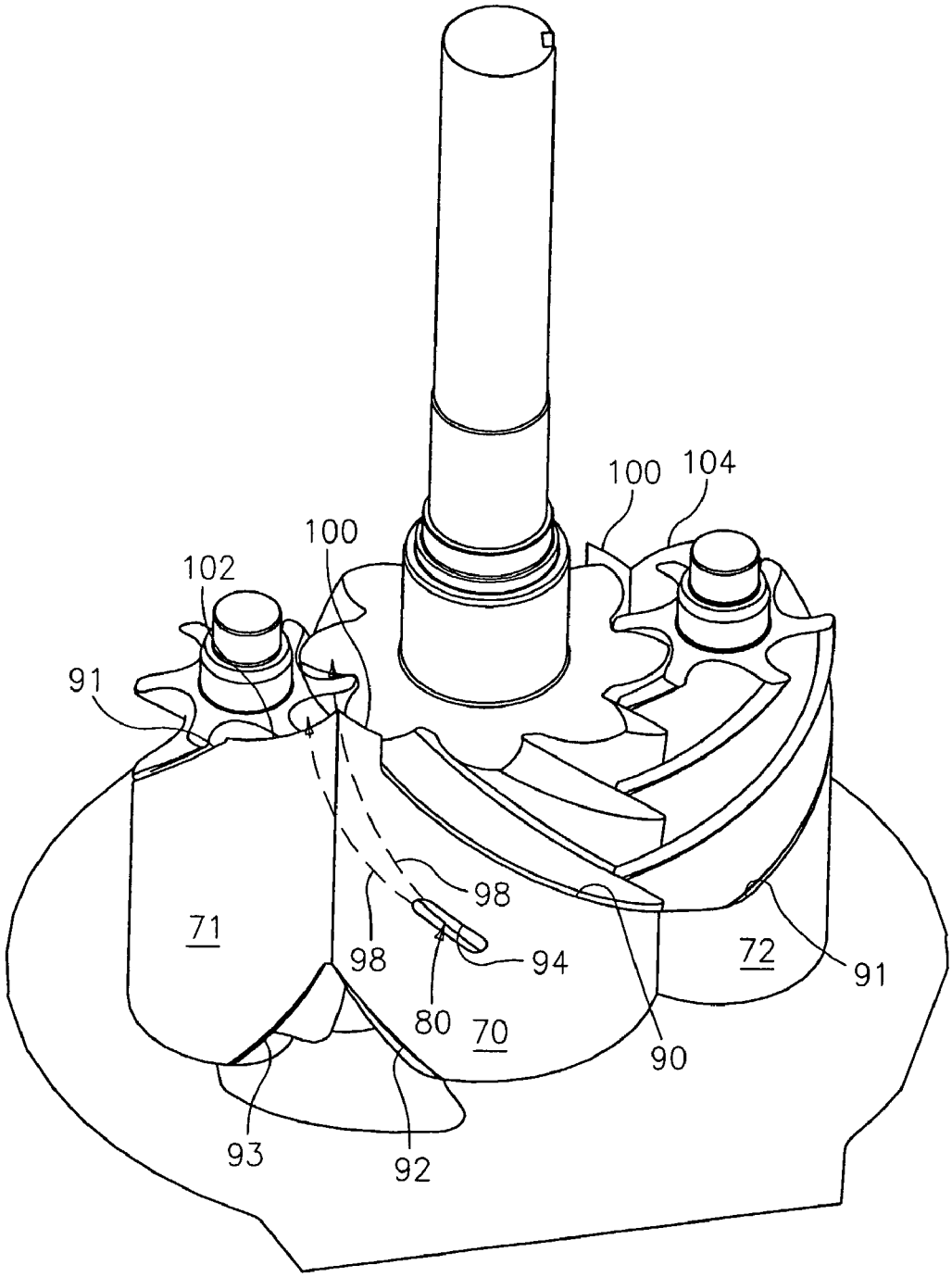
FIG. 4 is a view of the projected housing interior surface along rotors of the compressor of FIG. 1.

FIG. 4 shows a projection of the interior surface portions 70, 71, and 72 atop the rotor lobes. These surfaces are shown as having first and second edges 90 and 91 along the associated male and female rotors for each suction port and first and second edges 92 and 93 along the associated male and female rotors for each discharge port. A perimeter 94 defines a closed aperture associated with each economizer port 80 and penetrating the surface 70. There is a leakage path from each economizer port 80 back to the associated suction port. FIG. 4 shows this leakage path 98 as extending to intact circumferential portions 100 of the adjacent surface 70 and 102 or 104 of the adjacent surface 71 or 72.

Figure 5:
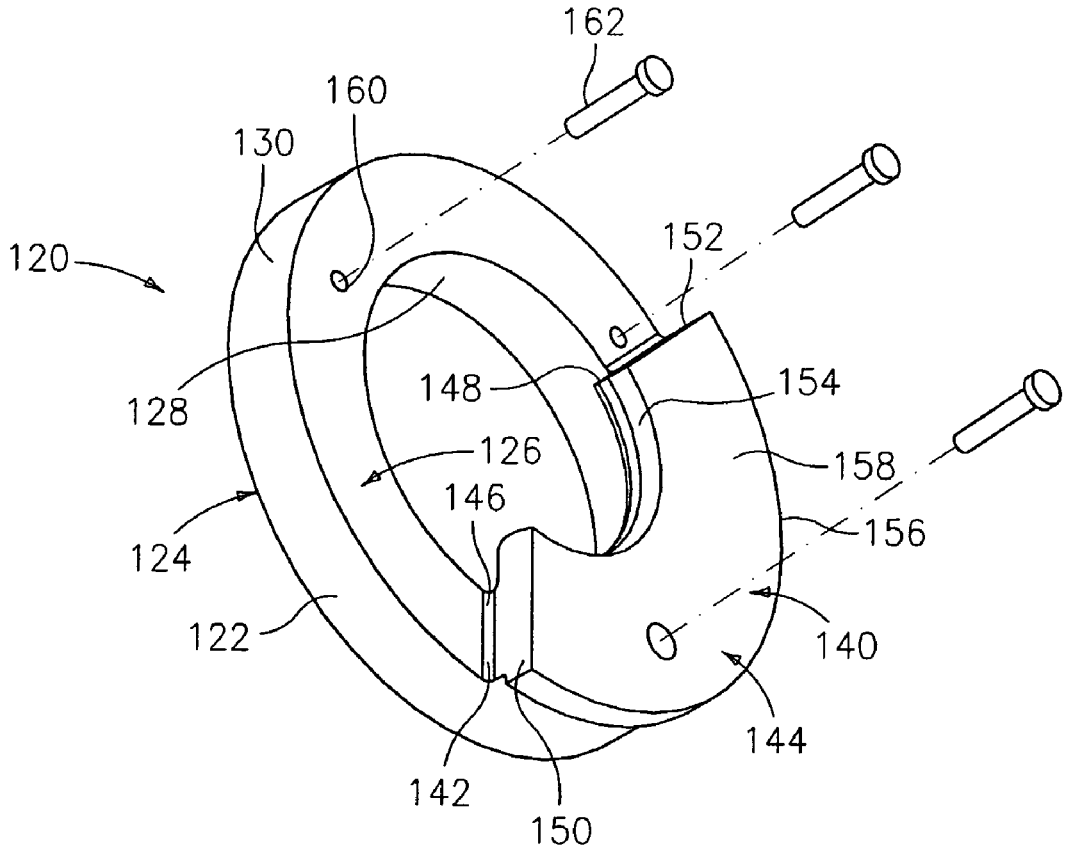
FIG. 5 is a view of a female rotor suction seal of the compressor of FIG. 1.

FIG. 5 shows a female rotor suction seal 120. The exemplary seal 120 is essentially unitarily formed of a metal alloy (e.g., steel). The exemplary seal 120 has a base or mounting portion 122 formed as a full annulus ring of rectangular radial section having an upstream end or face 124 and a downstream end or face 126 and having inboard and outboard surfaces 128 and 130 therebetween. A sealing portion 140 extends from the downstream face 126 and is formed having a trunk 142 and a main body 144. In the exemplary implementation, both the trunk and the main body are annular segments. The trunk extends between first and second circumferential ends 146 and 148 and the main body extends between first and second circumferential ends 150 and 152. In the exemplary implementation, the main body ends project slightly circumferentially beyond the trunk ends. In the exemplary implementation, trunk inboard and outboard surfaces are formed as continuation of the base inboard and outboard surfaces. The main body inboard and outboard surfaces 154 and 156 project respectively inward and outward relative to the base portion inboard and outboard surfaces. The main body 144 has a downstream surface 158.

The main body downstream surface 158 (rotor engagement face) has a radial and circumferential extent sufficient to seal the interlobe spaces along the associated leakage path 98 (e.g., along the portions 102; 104 and along a remaining lobe pocket area in communication with those portions 102; 104 (e.g., as shown in FIG. 4). The exemplary surface 158 forms a first surface being essentially an annular segment of an extent between 30° and 270°. This surface may seal an exemplary 1/12 to ¾, more narrowly, ¼ to ½, of a lobe-swept area of the female body portion first end 35. As is further shown in FIG. 3, the exemplary main body outboard surface 156 is at essentially equal radius to the lobes of the associated female rotor and the inboard surface 154 is in close radial position to the adjacent shaft stub (e.g., preferably at least at or below the radius of the interlobe troughs). In the exemplary implementation, the seal 120 has longitudinal apertures 160 for accommodating fasteners 162 (e.g., screws) to secure the seal within the housing. FIG. 2 shows the seal base portion 122 mounted in a seal compartment 170 with the upstream face 124 at least partially abutting a base face 172 of a compartment and the outboard surface 130 at least partially abutting a sidewall surface 174 of the compartment. The downstream face 158 of the main body 144 is in close facing or lubricated contacting relation with the rotor body end face 35 and the overlapping portion of the male rotor body face 31.

One or more embodiments of the present invention have been described. Nevertheless, it will be understood that various modifications may be made without departing from the spirit and scope of the invention. For example, when applied as a reengineering or remanufacturing of an existing compressor, details of the existing compressor may influence or dictate details of the particular implementation. Accordingly, other embodiments are within the scope of the following claims.

What is claimed is:

1. A compressor comprising:

a housing assembly;

a male rotor having a screw-type male body portion, the male rotor body portion extending from a first end to a second end and held within the housing assembly for rotation about a first rotor axis;

a female rotor having a screw-type female body portion enmeshed with the male body portion, the female body portion extending from a first end to a second end and held within the housing assembly for rotation about a second rotor axis; and an end seal having a first surface engaging the female body portion first end and being asymmetric around the second axis.

2. The compressor of claim 1 wherein the end seal includes a full-annulus base portion encircling the second rotor axis and a second portion bearing the first surface.

3. The compressor of claim 1 wherein the first surface is essentially an annular segment of an extent between 30° and 270°.

4. The compressor of claim 1 wherein the first surface is of only partial circumferential extent.

5. The compressor of claim 1 wherein the first surface seals 1/12 to 3/4 of a lobe-swept area of said female body portion first end.

6. The compressor of claim 1 wherein the first surface seals 1/4 to 1/2 of a lobe-swept area of said female body portion first end.

7. The compressor of claim 1 further comprising a motor coupled to the male rotor to drive the male rotor in at least said first direction about the first rotor axis and wherein the motor and male rotor are coaxial.

8. The compressor of claim 7 wherein the motor is an electric motor having a rotor and a stator and the male rotor has a shaft portion extending into and secured to the motor rotor.

9. The compressor of claim 1 wherein the end seal is essentially unitarily formed of steel.

10. The compressor of claim 1 wherein a plurality of threaded fasteners secure the end seal to the housing assembly.

11. A compressor comprising:

a housing assembly;

a male rotor having a screw-type male body portion, the male rotor body portion extending from a first end to a second end and held within the housing assembly for rotation about a first rotor axis; and a female rotor having a screw-type female body portion enmeshed with the male body portion, the female rotor body portion extending from a first end to a second end and held within the housing assembly for rotation about a second rotor axis;

a suction plenum;

a discharge plenum, the male and female rotor body portions cooperating with the housing to define at least a first compression path between the suction plenum and the discharge plenum;

an economizer port at an intermediate location along the first compression path; and means for resisting leakage from the economizer port to the suction plenum while still permitting an axial flow component from the suction plenum.

12. The compressor of claim 11 wherein the means comprises a rotor end seal with a circumferentially non-constant rotor engagement face.

13. The compressor of claim 12 wherein the rotor end seal includes a full-annulus base portion encircling the second rotor axis and a second portion bearing the rotor engagement face.

14. The compressor of claim 13 wherein the rotor engagement face is essentially an annular segment of an extent between 30° and 270°.

15. The compressor of claim 11 wherein the means comprises a rotor end seal with a rotor engagement face of only partial circumferential extent.

16. The compressor of claim 11 further comprising:

a second female rotor having a screw-type female lobed body portion enmeshed with the male lobed body portion.

17. A method for remanufacturing a compressor or engineering or reengineering a configuration of said compressor from a baseline condition to a second condition, the compressor comprising:

a housing assembly;

a male rotor having a screw-type male body portion, the male rotor body portion extending from a first end to a second end and held within the housing assembly for rotation about a first rotor axis; and a female rotor having a screw-type female body portion enmeshed with the male body portion, the female rotor body portion extending from a first end to a second end and held within the housing assembly for rotation about a second rotor axis;

a suction plenum; and a discharge plenum, the male and female rotor body portions cooperating with the housing to define at least a first compression path between the suction plenum and the discharge plenum, the method comprising:

providing an axial seal for sealing with said female rotor first end, the axial seal having a sealing surface asymmetric around said second axis, and wherein the axial seal either replaces a baseline axial seal having a sealing surface symmetric around said second axis or is located where there is no axial seal in the baseline condition.

18. The method of claim 17 wherein the compressor includes an economizer port.

* * * * *